US008137878B2

(12) United States Patent
Fujiwara

(10) Patent No.: US 8,137,878 B2
(45) Date of Patent: Mar. 20, 2012

(54) ELECTROPHOTOGRAPHIC PHOTORECEPTOR, METHOD FOR MANUFACTURING THE SAME, AND IMAGE-FORMING APPARATUS USING SAME

(75) Inventor: Yoshiaki Fujiwara, Shiga (JP)

(73) Assignee: Kyocera Corporation, Kyoto (JP)

( * ) Notice: Subject to any disclaimer, the term of this patent is extended or adjusted under 35 U.S.C. 154(b) by 931 days.

(21) Appl. No.: 12/109,300

(22) Filed: Apr. 24, 2008

(65) Prior Publication Data

US 2008/0286672 A1 Nov. 20, 2008

(30) Foreign Application Priority Data

Apr. 25, 2007 (JP) ..... 2007-116095

(51) Int. Cl.
*G03G 15/04* (2006.01)
*G03G 15/00* (2006.01)

(52) U.S. Cl. ..... 430/66; 430/59.2; 430/61; 399/159

(58) Field of Classification Search ..... 430/59.2, 430/61, 66; 399/159
See application file for complete search history.

(56) References Cited

U.S. PATENT DOCUMENTS 5,252,418 A * 10/1993 Ishikawa et al. ..... 430/67

FOREIGN PATENT DOCUMENTS

| | | |
|---|---|---|
| JP | 02-226161 | 9/1990 |
| JP | 1992-191748 | 7/1992 |
| JP | 05-119502 | 5/1993 |
| JP | 08-262753 | 10/1996 |
| JP | 10-069198 | 3/1998 |
| JP | 2000-029231 | 1/2000 |

OTHER PUBLICATIONS

English translation of "Request for Accelerated Examination" of corresponding JP application 2008-115305.

* cited by examiner

*Primary Examiner* — Thorl Chea
(74) *Attorney, Agent, or Firm* — Birch, Stewart, Kolasch & Birch, LLP

(57) ABSTRACT

The invention relates to an electrophotographic photoreceptor in which protrusions from the surface of the photoreceptor are partly or completely covered by a resin. The effect of such resin covering is to reduce toner deposition, thereby reducing or eliminating spotting defects in images formed using the electrophotographic photoreceptor. The invention further relates to an image-forming apparatus incorporating such an electrophotographic photoreceptor.

15 Claims, 8 Drawing Sheets

ELECTROPHOTOGRAPHIC PHOTORECEPTOR, METHOD FOR MANUFACTURING THE SAME, AND IMAGE-FORMING APPARATUS USING SAME

CROSS-REFERENCE TO RELATED APPLICATIONS

The present application claims priority under 35 U.S.C. §119 to Japanese Patent Application No. 2007-116095, filed Apr. 25, 2007, entitled "ELECTROPHOTOGRAPHIC PHOTORECEPTOR, METHOD FOR MANUFACTURING THE SAME, AND IMAGE-FORMING APPARATUS" The contents of this application are incorporated herein by reference in their entirety.

BACKGROUND OF THE INVENTION

1. Field of the Invention

The present invention relates to an electrophotographic photoreceptor, a method for manufacturing the electrophotographic photoreceptor, and an image-forming apparatus that includes the electrophotographic photoreceptor.

2. Description of the Related Art

The production of electrophotographic photoreceptors that include an amorphous silicon (hereinafter referred to as "a-Si") photosensitive layer is increasing year by year because of their high abrasion resistance, high heat resistance, high photosensitivity, and nonpolluting characteristics.

One of such electrophotographic photoreceptors includes an a-Si photosensitive layer that is formed on a cylindrical aluminum alloy substrate by a thin-film forming method (for example, a glow discharge decomposition method). This a-Si photosensitive layer includes an a-Si photoconductive layer and a surface layer formed thereon. The a-Si photosensitive layer may include a carrier injection preventing layer between the cylindrical substrate and the photoconductive layer.

However, in electrophotographic photoreceptors having such a structure, the photosensitive layer may have a protrusion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
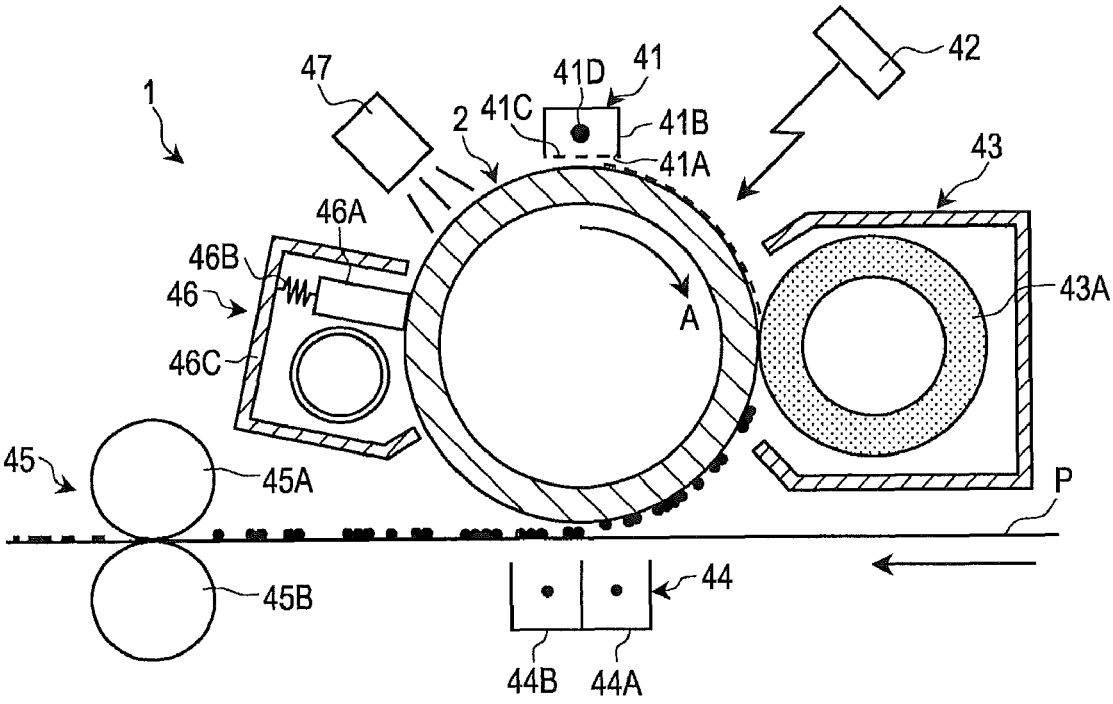
FIG. 1 is a schematic view of an image-forming apparatus according to an embodiment of the present invention.

According to an aspect of the present invention, an electrophotographic photoreceptor includes a substrate, a photosensitive layer and a resin portion. The photosensitive layer is disposed on the substrate and has a protrusion thereon. The resin portion partly or entirely covers the protrusion.

According to another aspect of the present invention, a method for manufacturing an electrophotographic photoreceptor includes the steps of: forming a photosensitive layer on the outer surface of a cylindrical substrate; and partly or entirely covering a protrusion disposed on the photosensitive layer with a resin.

According to further aspect of the present invention, an image-forming apparatus includes the electrophotographic photoreceptor.

Some embodiments of the invention will now be described with reference to the accompanying drawings, wherein like reference numerals designate corresponding or identical elements throughout the various drawings.

As illustrated in FIG. 1, an image-forming apparatus 1 utilizes a Carlson process as an image-forming method. The image-forming apparatus 1 includes an electrophotographic photoreceptor 2, a charger 41, an exposure unit 42, a developing unit 43, a transfer unit 44, a fixing unit 45, a cleaning unit 46, and a static eliminator 47.

The charger 41 is of a non-contact type. The charger 41 includes a housing 41B having an opening 41A facing the electrophotographic photoreceptor 2, the grid electrode 41C disposed at the opening 41A, and a charging wire 41D disposed inside the housing 41B.

The charger may be a contact charger in place of the non-contact charger 41. The contact charger may have a charging roller. For example, the charging roller includes an electroconductive rubber roller and a metal shaft disposed at the center of the electroconductive rubber roller. A direct-current (DC) voltage or a voltage of DC and alternating current (AC) is applied to the metal shaft to charge the electrophotographic photoreceptor 2 directly.

The exposure unit 42 can emit light having a particular wavelength (for example, in the range of 650 to 780 nm) and forms an electrostatic latent image on the electrophotographic photoreceptor 2. The exposure unit 42 can irradiate the electrophotographic photoreceptor 2 with light corresponding to a picture signal to reduce the electric potential at the irradiated portion, thus forming an electrostatic latent image as a voltage contrast. The exposure unit 42 may include a light-emitting diode (LED) head including a plurality of LED devices (wavelength: about 680 nm). Alternatively, in place of the LED head, the exposure unit 42 may include an optical system that includes a laser beam and a polygonal mirror, or an optical system that includes a lens and a mirror each transmitting light reflected from an object to be printed.

The developing unit 43 develops an electrostatic latent image of the electrophotographic photoreceptor 2 to form a toner image. The developing unit 43 includes a developing roller 43A for retaining a developing agent (toner), and a wheel (not shown) for maintaining a substantially constant gap between the developing unit 43 and the electrophotographic photoreceptor 2. The developing agent composes a toner image that is formed on the electrophotographic photoreceptor 2. The developing agent may be a one-component system containing a toner or a two-component system containing a toner and a carrier.

The developing roller 43A conveys a developing agent to the surface (particularly to an area to be developed) of the electrophotographic photoreceptor 2. The developing roller 43A is charged at a predetermined electric potential with a predetermined polarity upon the application of a direct-current voltage or an alternating voltage.

In the developing unit 43, the developing agent conveyed by the developing roller 43A adheres to an area to be developed on the electrophotographic photoreceptor 2 by the electrostatic attraction force between the developing agent and an electrostatic latent image, thus visualizing the latent image. When a toner image is formed by normal development, the charge polarity of the toner image is opposite to the charge polarity of the surface of the electrophotographic photoreceptor 2. When a toner image is formed by reversal development, the charge polarity of the toner image is the same as the charge polarity of the surface of the electrophotographic photoreceptor 2.

The transfer unit 44 transfers a toner image formed on the electrophotographic photoreceptor 2 to a recording medium P supplied to a transfer area between the electrophotographic photoreceptor 2 and the transfer unit 44. The transfer unit 44 includes a transfer charger 44A and a detach charger 44B. In the transfer unit 44, the back (non-recording surface) of the recording medium P is charged oppositely to the toner image by the transfer charger 44A. The electrostatic attraction force between the charged electricity and the toner image allows the toner image to be transferred to the recording medium P. In the transfer unit 44, synchronously with the transfer of the toner image, the back of the recording medium P is charged by an alternating current by the detach charger 44B. Consequently, the recording medium P is immediately separated from the surface of the electrophotographic photoreceptor 2.

The transfer unit 44 may be a transfer roller, which is disposed facing to the electrophotographic photoreceptor 2 with a minute gap (typically 0.5 mm or less) therebetween. The transfer roller is designed to apply a transfer voltage to the recording medium P, for example, with a direct-current power source to attract a toner image formed on the electrophotographic photoreceptor 2 to the recording medium P. The use of the transfer roller can eliminate a detach apparatus, such as the detach charger 44B.

The fixing unit 45 includes a pair of fixing rollers 45A and 45B, and fixes a transferred toner image on the recording medium P. The fixing rollers 45A and 45B may be a metal roller coated with Teflon (registered trademark). The fixing unit 45 fixes a toner image, for example, by heating the recording medium P and applying pressure on the recording medium P when the recording medium P passes between the pair of fixing rollers 45A and 45B.

The cleaning unit 46 includes a cleaning blade 46A, a spring 46B, and a case 46C, and removes a developing agent that remains on the electrophotographic photoreceptor 2. The cleaning blade 46A scrapes a residual toner off the surface of a surface layer 29 of the electrophotographic photoreceptor 2. The cleaning blade 46A is supported by the case 46C via an urging means, such as the spring 46B, such that the front-end of the cleaning blade 46A is pressed against the outer surface (surface layer 29 in FIG. 2B) of the electrophotographic photoreceptor 2. The cleaning blade 46A may be formed of a rubber material mainly composed of a polyurethane resin. The front-end of the cleaning blade 46A in contact with the surface layer 29 typically has a thickness in the range of 1.0 to 1.2 mm. The linear pressure of the cleaning blade 46A against the surface layer 29 may be 0.14 gf/cm (typically in the range of 0.05 to 0.3 gf/cm). The cleaning blade 46A may have a hardness of 74 (suitably in the range of 67 to 84) according to JIS K 6253 (ISO 7619).

The static eliminator 47 removes surface charges (a remaining electrostatic latent image) of the electrophotographic photoreceptor 2. The static eliminator 47 irradiates the outer surface (surface layer 29 in FIG. 2B) of the electrophotographic photoreceptor 2 with light from a light source, such as an LED, thus removing surface charges of the electrophotographic photoreceptor 2.

Figure 2A:
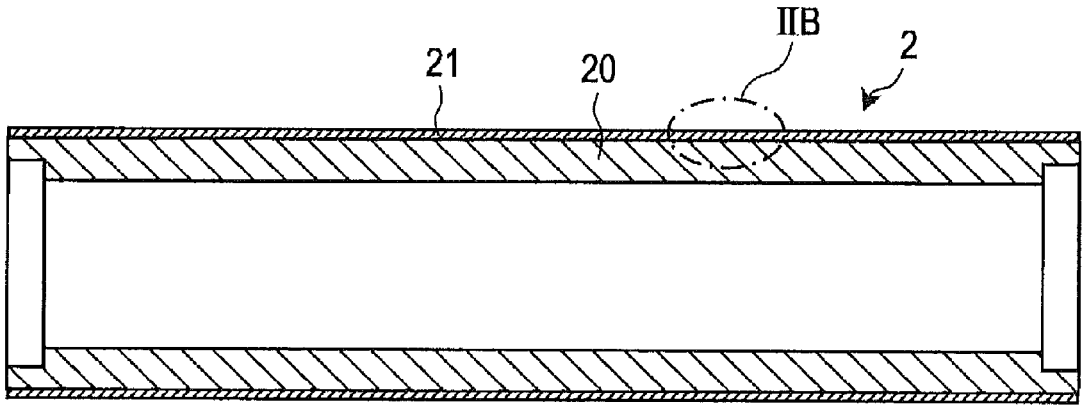
FIG. 2A is a schematic cross-sectional view of an electrophotographic photoreceptor according to an embodiment of the present invention.

An electrostatic latent image and a toner image are formed on the electrophotographic photoreceptor in response to a picture signal. The electrophotographic photoreceptor can rotate in the direction of arrow A in FIG. 1. As illustrated in FIG. 2A, the electrophotographic photoreceptor 2 includes a photosensitive layer 21 formed on a cylindrical substrate 20.

The cylindrical substrate 20 is a base body of the electrophotographic photoreceptor 2. At least the surface of the cylindrical substrate 20 is electrically conductive. More specifically, the cylindrical substrate 20 may be formed entirely of an electroconductive material, or may be an insulating cylindrical body having an electroconductive film thereon. Examples of the electroconductive material that forms the cylindrical substrate 20 include metals, such as Al, stainless steel (SUS), Zn, Cu, Fe, Ti, Ni, Cr, Ta, Sn, Au, and Ag, and alloys thereof. Examples of an insulating material that forms the cylindrical substrate 20 include resins, glasses, and ceramics. Examples of a material that forms the electroconductive film of the cylindrical substrate 20 include the same metals as the electroconductive material that forms the cylindrical substrate 20 and transparent electroconductive materials, such as indium tin oxide (ITO) and $SnO_2$. Preferably, the cylindrical substrate 20 is formed entirely of an Al alloy material. An Al alloy material can reduce the weight and the cost of the electrophotographic photoreceptor 2. In addition, when a charge injection preventing layer 27 and a photoconductive layer 28 of the photosensitive layer 21 described below are formed of an amorphous silicon (a-Si) material, the adhesiveness between the electrophotographic photoreceptor 2 and the charge injection preventing layer 27 or the photoconductive layer 28 increases. This also increases the reliability.

The photosensitive layer 21 may be composed of the charge injection preventing layer 27, the photoconductive layer 28, and the surface layer 29.

The charge injection preventing layer 27 prevents electrons and/or holes of the cylindrical substrate 20 from being injected into the photoconductive layer 28. A material of the charge injection preventing layer 27 depends on the material of the photoconductive layer 28, and may be an inorganic material, such as an a-Si material. The charge injection preventing layer 27 may be omitted. Furthermore, the charge injection preventing layer 27 may be replaced with a layer absorbing long-wavelength light. The layer absorbing long-wavelength light can prevent incident light having a long wavelength of at least 0.8 μm from being reflected from the cylindrical substrate 20 and forming interference fringes on a recorded image during exposure.

In the photoconductive layer 28, exposure to a laser beam from the exposure unit 42 excites electrons and generates carriers, such as free electrons or holes. The thickness of the photoconductive layer 28 depends on the photoconductive material and desired electrophotographic characteristics, and may be in the range of 5 to 100 μm (suitably in the range of 15 to 80 μm).

The photoconductive layer 28 is formed of an a-Si material. Examples of the a-Si material include a-Si, amorphous silicon carbide (a-SiC), amorphous silicon nitride (a-SiN), amorphous silicon oxide (a-SiO), amorphous silicon germanium (a-SiGe), amorphous silicon carbonitride (a-SiCN), amorphous silicon oxynitride (a-SiNO), amorphous silicon oxycarbide (a-SiCO), and amorphous silicon oxycarbonitride (a-SiCNO). In particular, a photoconductive layer 28 formed of a-Si or an a-Si alloy material composed of an a-Si and an element, such as C, N, or O, consistently has excellent electrophotographic characteristics, such as high photosensitivity, high responsivity, good repetition stability, good heat resistance, and high durability. In addition, this photoconductive layer 28 has high compatibility with a surface layer 29 formed of hydrogenated a-SiC (hereinafter referred to as a-SiC:H). The photoconductive layer 28 may contain particles of the a-Si material described above dispersed in a resin, or may be an organic photo conductor (OPC) layer.

When the photoconductive layer 28 is formed entirely of an inorganic substance, the photoconductive layer 28 may be formed by a known method, such as glow discharge decomposition, sputtering, vapor deposition, electron cyclotron resonance (ECR), photo-CVD, catalytic CVD, or reactive evaporation.

Figure 3:
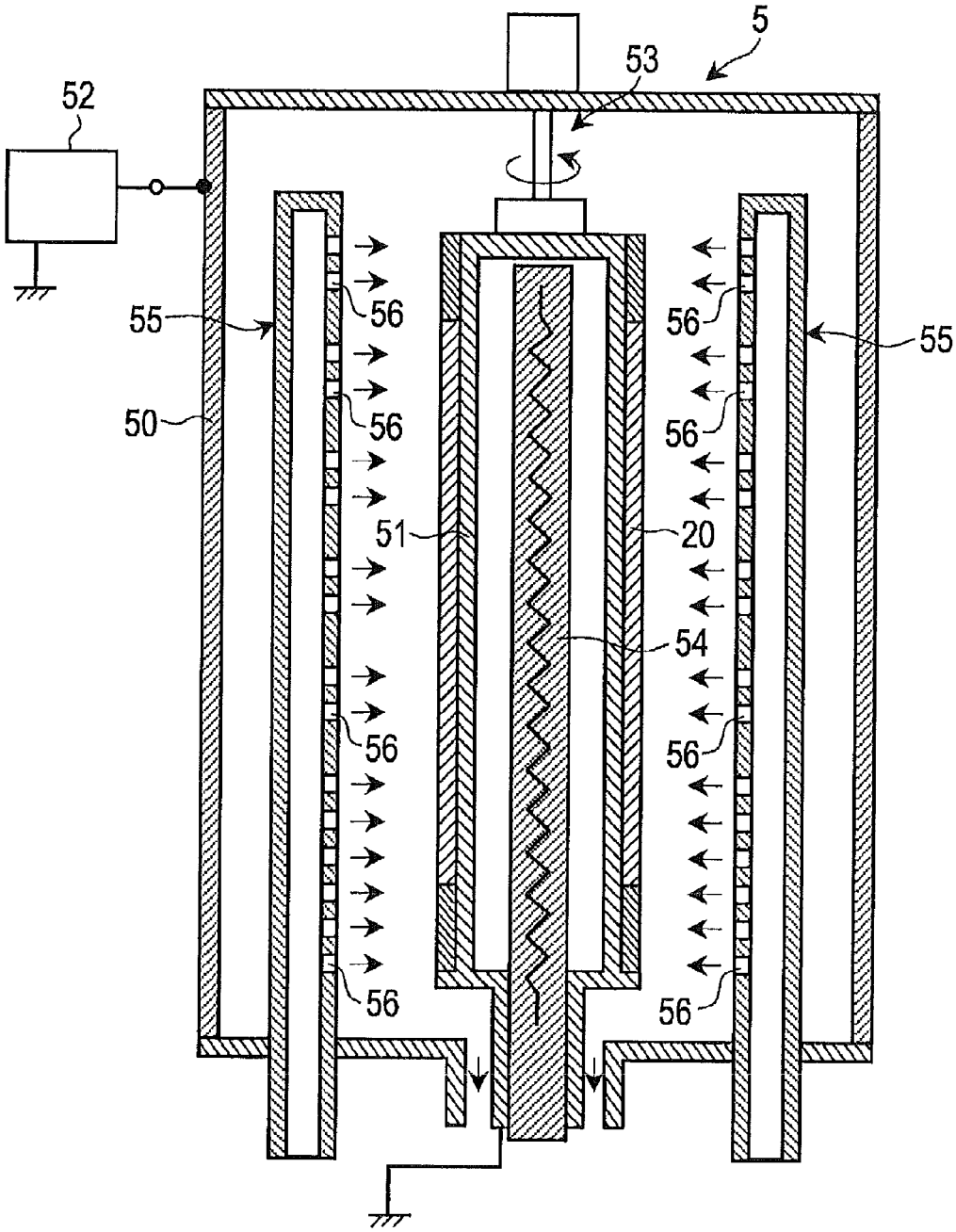
FIG. 3 is a schematic cross-sectional view of a plasma chemical vapor deposition (CVD) apparatus for forming a photosensitive layer in the electrophotographic photoreceptor illustrated in FIG. 2A.

The photoconductive layer 28 may be formed with a plasma CVD apparatus 5 illustrated in FIG. 3. The plasma CVD apparatus 5 includes a substrate support 51 at the center of a cylindrical vacuum vessel 50. An a-Si film is formed by glow discharge plasma on a cylindrical substrate 20 supported by the substrate support 51. The vacuum vessel 50 is coupled to a high-frequency power source 52. A high-frequency power is applied between the vacuum vessel 50 and the substrate support 51 (cylindrical substrate 20) which is grounded. The substrate support 51 can be rotated by a rotation mechanism 53, and is heated by a heater 54 disposed in the substrate support 51. The plasma CVD apparatus 5 further includes a plurality of gas-inlet pipes 55 surrounding the substrate support 51 (cylindrical substrate 20). Each of the gas-inlet pipes 55 includes a plurality of gas inlets 56 disposed in the axial direction. The gas inlets 56 face the cylindrical substrate 20 so that a reaction gas blows out from the gas inlets 56 toward the cylindrical substrate 20.

In the formation of an a-Si film on the cylindrical substrate 20 with the plasma CVD apparatus 5, a reaction gas having a predetermined composition is blown on the cylindrical substrate 20 at a predetermined flow rate from the gas-inlet pipes 55 via the gas inlets 56, while the cylindrical substrate 20, together with the substrate support 51, is rotated by the rotation mechanism 53. The high-frequency power source 52 applies a high-frequency power between the vacuum vessel 50 and the substrate support 51 (cylindrical substrate 20) to decompose the reaction gas by glow discharge, thereby forming an a-Si film on the cylindrical substrate 20, which is maintained at a desired temperature.

Figure 2B:
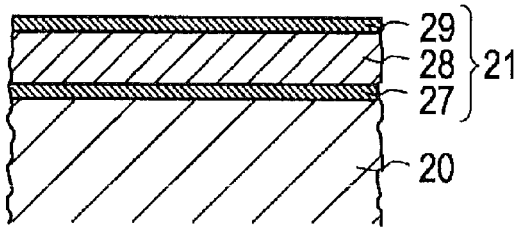
FIG. 2B is an enlarged view of a principal part thereof.

As illustrated in FIG. 2B, the surface layer 29, which is formed on the photoconductive layer 28, protects the photoconductive layer 28 from friction and abrasion. The surface layer 29 is formed of an inorganic material, such as an a-Si material. The thickness of the surface layer 29 is in the range of 0.2 to 1.5 μm (suitably in the range of 0.5 to 1.0 μm). The surface layer 29 having a thickness of at least 0.2 μm can reduce image flaws and inconsistencies in image density due to impression durability. The surface layer 29 having a thickness of 1.5 μm or less improves initial properties (for example, image defects due to residual potential).

Figure 4:
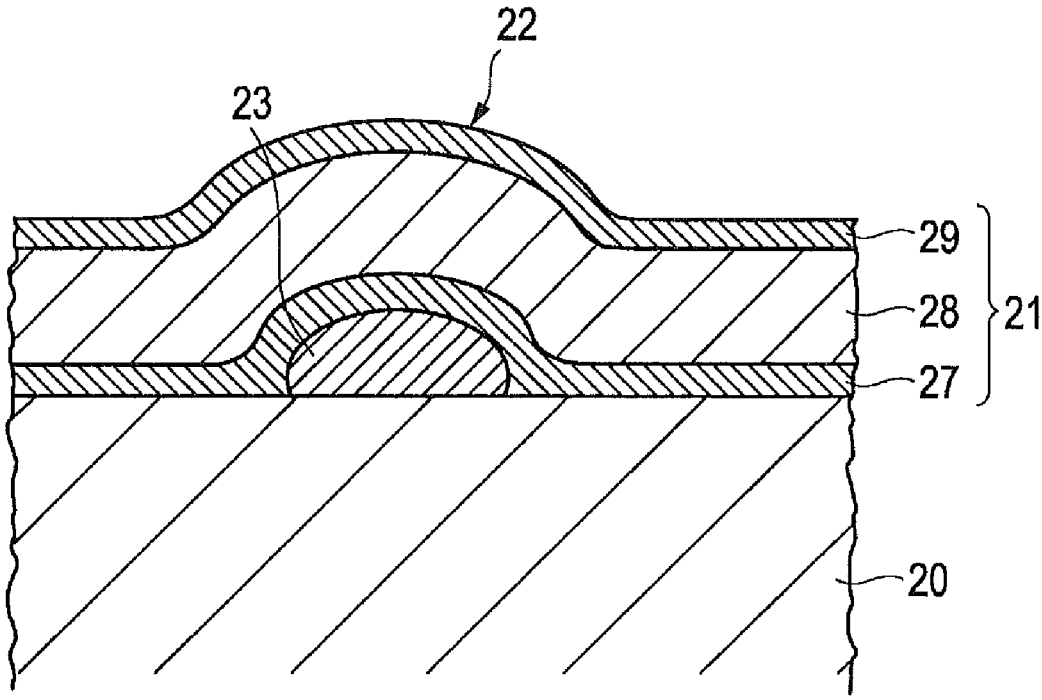
FIG. 4 is a schematic cross-sectional view of a principal part of an electrophotographic photoreceptor to illustrate a protrusion disposed on a photosensitive layer.

A surface layer 29 formed of a-SiC:H can be formed with the plasma CVD apparatus 5 illustrated in FIG. 3, in the same way as the photoconductive layer 28 formed of an a-Si material. When an a-Si photosensitive layer 21 is formed with the plasma CVD apparatus 5, a protrusion 22 may be formed at the surface of the photosensitive layer 21, as illustrated in FIG. 4. This protrusion 22 may be formed by abnormal growth of a foreign particle 23 deposited on the surface of the cylindrical substrate 20 or during the formation of the photosensitive layer 21. The protrusion 22 may cause an image defect, as described above.

Figure 5A:
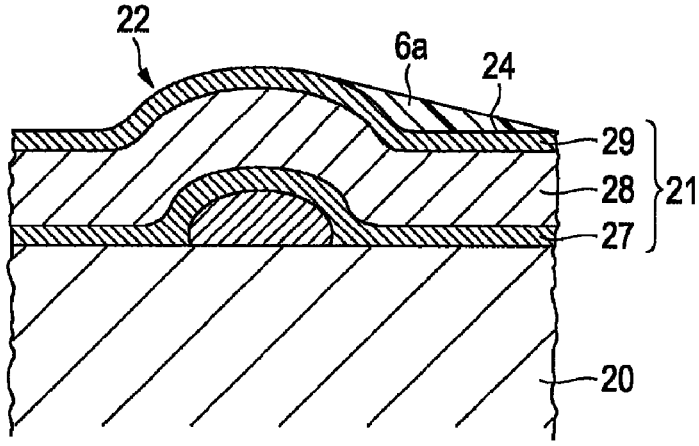
FIGS. 5A to 5C are schematic cross-sectional views of a principal part of an electrophotographic photoreceptor to illustrate a resin portion that partly (5A, 5B) or entirely (5C) covers a protrusion disposed on a photosensitive layer.
Figure 5B:
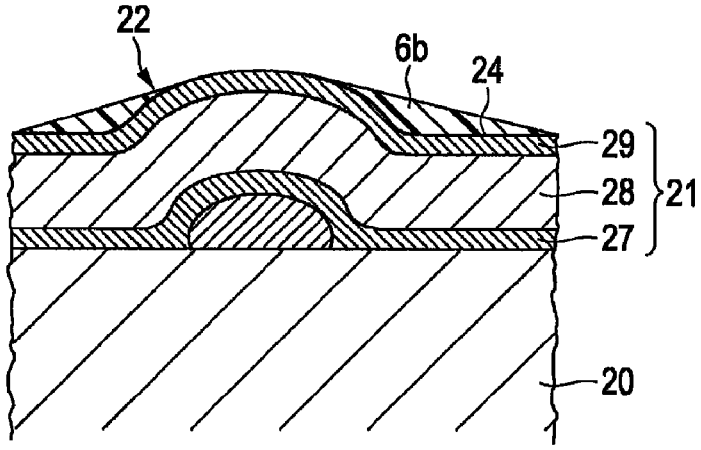
Figure 5C:
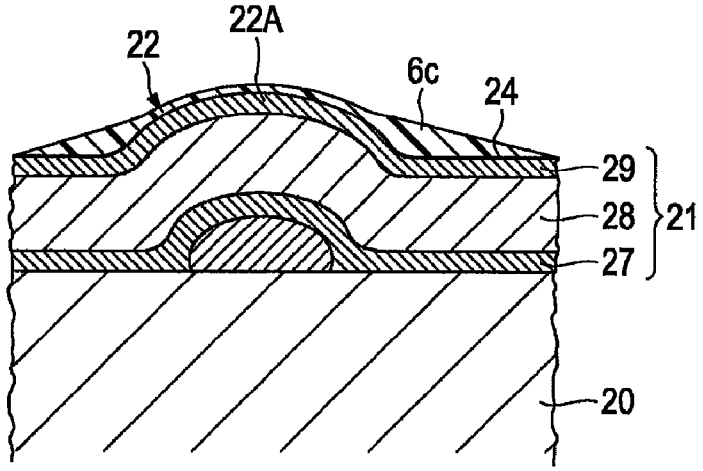

In the electrophotographic photoreceptor 2, as illustrated in FIGS. 5A to 5C, resin portion 6*a*, 6*b*, or 6*c* partly or entirely covers a protrusion 22.

As illustrated in FIG. 5A, the resin portion 6*a* is formed on the front side of the protrusion 22 in the rotation direction of the electrophotographic photoreceptor 2 so that the resin portion 6*a* reduces a difference in level between the protrusion 22 and a normal surface 24.

As illustrated in FIG. 5B, the resin portion 6*b* is formed on the front and rear sides of the protrusion 22 in the rotation direction of the electrophotographic photoreceptor 2 so that the resin portion 6*b* reduces a difference in level between the protrusion 22 and the normal surface 24.

As illustrated in FIG. 5C, a resin portion 6*c* entirely covers the protrusion 22. More specifically, the resin portion 6*c* covers the top 22A of the protrusion 22, as well as the front and rear sides of the protrusion 22 in the rotation direction of the electrophotographic photoreceptor 2.

Figure 6:
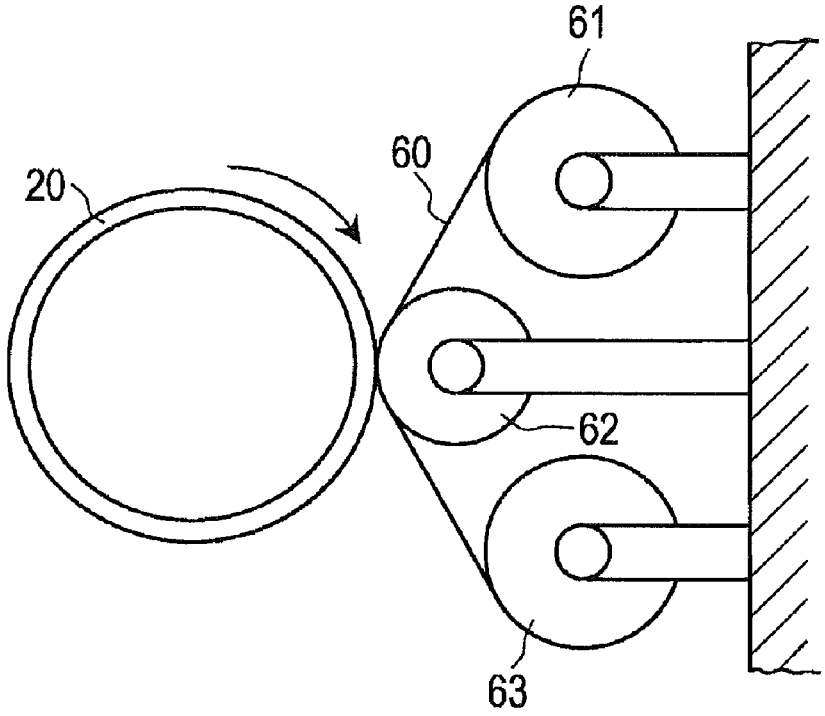
FIG. 6 is a schematic view of an apparatus for forming a resin portion.

As illustrated in FIG. 6, the resin portions 6*a*, 6*b*, and 6*c* illustrated in FIGS. 5A to 5C can be formed by making a resin sheet 60 contact with the photosensitive layer 21 (see FIG. 2A) disposed on the cylindrical substrate 20, which is rotatably supported, for example, by an umbrella-shaped center pin (not shown) for use in a lathe. The resin sheet 60 supplied from a resin roller 61 is pressed against the photosensitive layer 21 by a rear roller 62. The rear roller 62 generally rotates in the different direction as the cylindrical substrate 20. The resin sheet 60 is wound around a recovery roller 63.

The nip width between the photosensitive layer 21 and the resin sheet 60 is controlled by the hardness of the resin sheet 60 and the pressing force of the rear roller 62 against the photosensitive layer 21 via the resin sheet 60. The resin sheet 60 may be a monolayer of a resin material of the resin portion 6*a*, 6*b*, or 6*c*, or a multilayer composed of the resin materials on a base sheet. Examples of the resin material include "fluorocarbon resins" (which include at least one fluorine atom and may include other halogen atoms), polystyrene resins, and polyethylene resins. Fluorocarbon resins are preferred in terms of the prevention of toner deposition. Examples of the fluorocarbon resins include polytetrafluoroethylene, polychlorotrifluoroethylene, polyvinylidene fluoride, polyvinyl fluoride, perfluoroalkoxy fluorocarbons, tetrafluoroethylene-hexafluoropropylene copolymers, ethylene-tetrafluoroethylene copolymers, and ethylene-chlorotrifluoroethylene copolymers. The pressing force of the rear roller 62 against the photosensitive layer 21 via the resin sheet 60 may be in the range of 0.01 to 0.2 kgf/cm$^2$ (9.806×10 to 1.961×10 Pa) per unit axial length. The nip width may be in the range of 0.01 to 2 mm.

Figure 7:
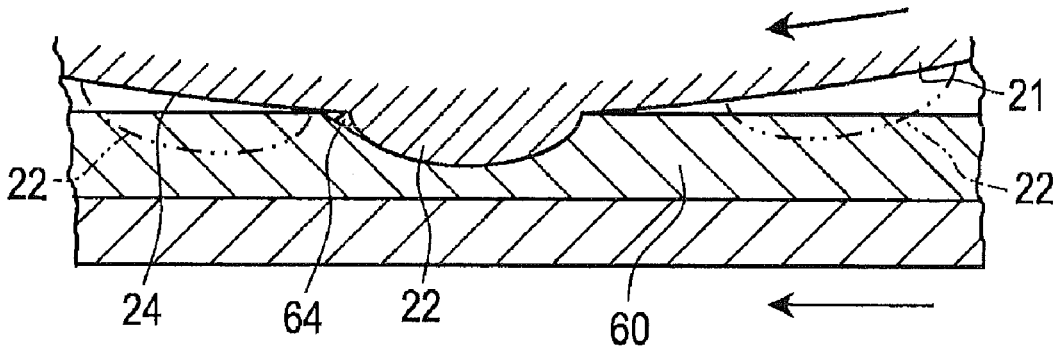
FIG. 7 is a schematic cross-sectional view illustrating how a protrusion disposed on a photosensitive layer scrapes resin off a resin film.

As illustrated in FIG. 7, when the resin sheet 60 moves relative to the cylindrical substrate 20 while the resin sheet 60 is in contact with the photosensitive layer 21, the protrusion 22 scrapes a resin 64 off the resin sheet 60. The resin 64 adheres to the photosensitive layer 21 to reduce a difference in level between the protrusion 22 and the normal surface 24. The nip width between the photosensitive layer 21 and the resin sheet 60, the hardness of the resin sheet 60 (the composition of the resin material), or the moving speed of the resin sheet 60 is appropriately controlled to apply the resin portion 6*a*, 6*b*, or 6*c* to the side and/or the top of the protrusion 22 while the resin adhering to the normal surface 24 is minimized, as illustrated in FIGS. 5A to 5C.

In the electrophotographic photoreceptor 2, at least part of the side of the protrusion 22 disposed on the photosensitive layer 21 is covered with the resin portion 6*a*, 6*b*, or 6*c*. This can reduce the toner deposition at a stepped portion 25 between the protrusion 22 and the normal surface 24, and allows toner around the protrusion 22 to be removed easily with the cleaning blade 46A. Furthermore, the reduction in toner deposition around the protrusion 22 can reduce toner adherence to the photosensitive layer 21.

Thus, in the electrophotographic photoreceptor 2 and the image-forming apparatus 1 including the electrophotographic photoreceptor 2, image defects caused by the toner deposition around the protrusion 22, as well as insufficient cleaning and black-striped image defects, can be reduced.

Other examples of the resin portion are described below with reference to FIGS. 8A to 8C and FIG. 9.

Figure 8A:
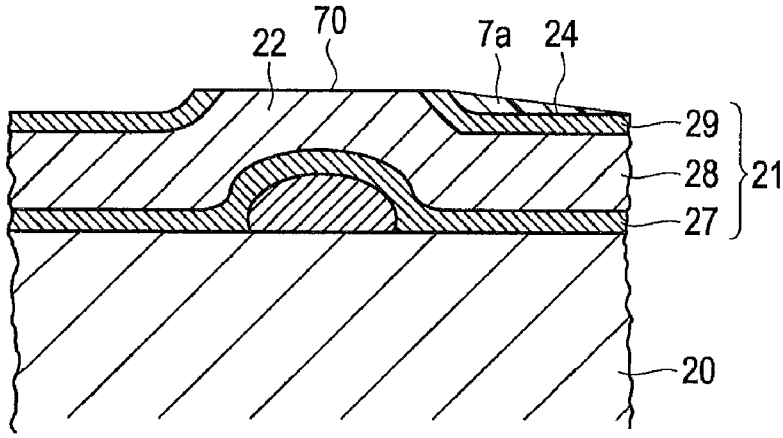
FIGS. 8A to 8C are schematic cross-sectional views of a principal part of an electrophotographic photoreceptor to illustrate a resin portion that partly (8A, 8B) or entirely (8C) covers a protrusion disposed on a photosensitive layer.
Figure 8B:
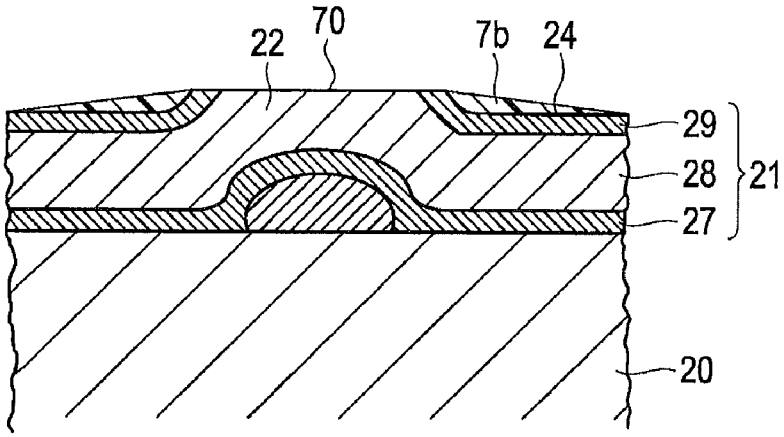
Figure 8C:
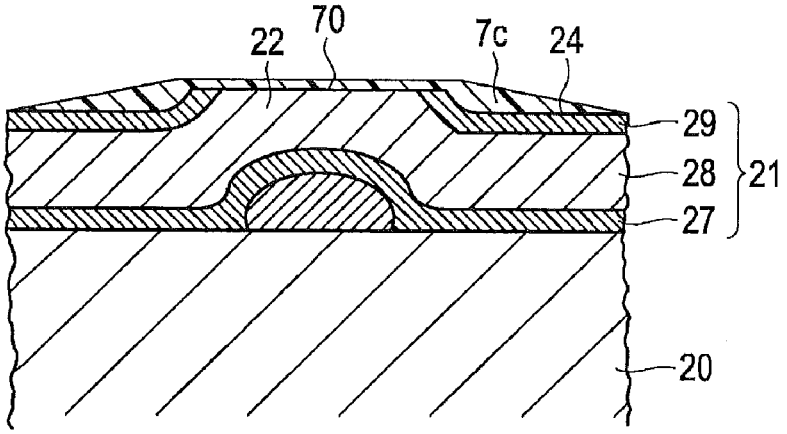

As illustrated in FIGS. 8A to 8C, a resin portion 7*a*, 7*b*, or 7*c* partly or entirely covers the side of the protrusion 22, or entirely covers the protrusion 22 having a flat top 70.

As illustrated in FIG. 8A, the resin portion 7*a* corresponds to a truncated form of the protrusion 22 illustrated in FIG. 5A. As illustrated in FIG. 8B, the resin portion 7*b* corresponds to a truncated form of the protrusion 22 illustrated in FIG. 5B. As illustrated in FIG. 8C, the resin portion 7*c* corresponds to a truncated form of the protrusion 22 illustrated in FIG. 5C.

The resin portions 7*a*, 7*b*, and 7*c* can be formed in the same way as the resin portions 6*a*, 6*b*, and 6*c* illustrated in FIGS. 5A to 5C, except that the protrusion 22 is truncated.

The protrusion 22 may be truncated using a lapping sheet in place of the resin sheet 60 of the apparatus illustrated in FIG. 6. The direction of movement of the lapping sheet may follow the rotation direction of the cylindrical substrate 20, or may be the opposite direction thereof.

Figure 9:
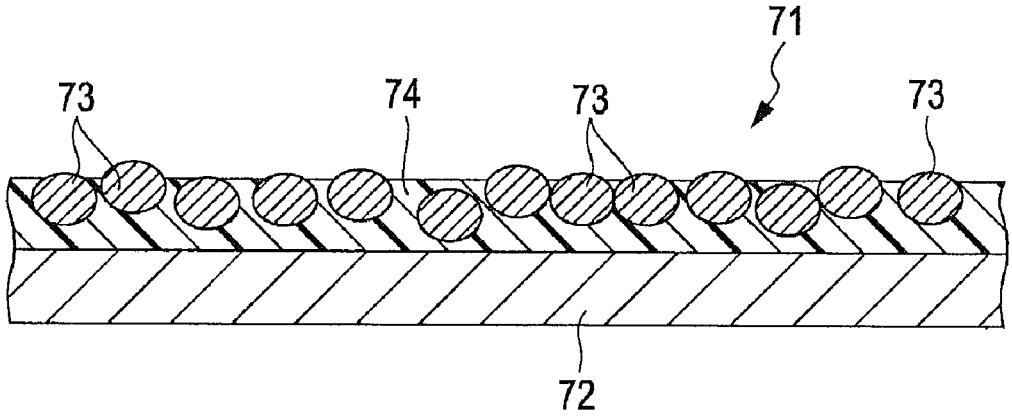
FIG. 9 is a schematic cross-sectional view of a principal part of a lapping sheet for grinding a resin portion.

As illustrated in FIG. 9, a lapping sheet 71 includes a base sheet 72 and a polymer resin binder 74 containing abrasive particles 73. Preferably, the base sheet 72 is a polyester that does not expand and contract significantly and has a uniform thickness. Examples of the abrasive particles 73 include silicon carbide, iron oxide, chromium oxide, aluminum oxide, and diamond particles. The size of the abrasive particles 73 may be in the range of 0.3 to 20 μm.

The protrusion 22 is ground with the lapping sheet 71 to form a truncated protrusion 22. The height of the truncated protrusion 22 is appropriately determined in a manner that depends on the size of the protrusion 22. For example, when the protrusion 22 has a diameter of 0.3 mm or less and a height of 60 μm or less, the height of the truncated protrusion 22 may be in the range of about 0.1 to 1 μm.

After the protrusion 22 is ground, the lapping sheet 71 of the apparatus is replaced with the resin sheet 60. In the same way as the resin portions 6*a*, 6*b*, and 6*c* illustrated in FIGS. 5A to 5C, the resin portion 7*a*, 7*b*, or 7*c* is formed to reduce a difference in level between the protrusion 22 (flat top 70) and the normal surface 24.

Grinding of the protrusion 22 and the formation of the resin portion 7*a*, 7*b*, or 7*c* may be performed in a single step by controlling the type of the lapping sheet 71 (the type and the particle size of abrasive particles, the type of a binder, etc.), the nip width between the photosensitive layer 21 and the lapping sheet 71, and the moving speed of the lapping sheet 71 relative to the cylindrical substrate 20.

Thus, in the electrophotographic photoreceptor 2 having the resin portion 7*a*, 7*b*, or 7*c* and the image-forming apparatus 1 including the electrophotographic photoreceptor 2, image defects caused by the toner deposition around the protrusion 22, as well as insufficient cleaning and black-striped image defects, can be reduced.

Furthermore, even when the protrusion 22 comes into contact with the cleaning blade 46A, a reduction in height of the protrusion 22 can reduce frictional heat and damage to the cleaning blade 46A. This can further reduce adhesion of toner to the photosensitive layer 21, and further reduce the occurrence of insufficient cleaning and black-striped image defects.

The resin portions 6*a*, 6*b*, 6*c*, 7*a*, 7*b*, and 7*c* may be formed not only by the methods described above, but also using a liquid material containing a resin material.

Figure 10:
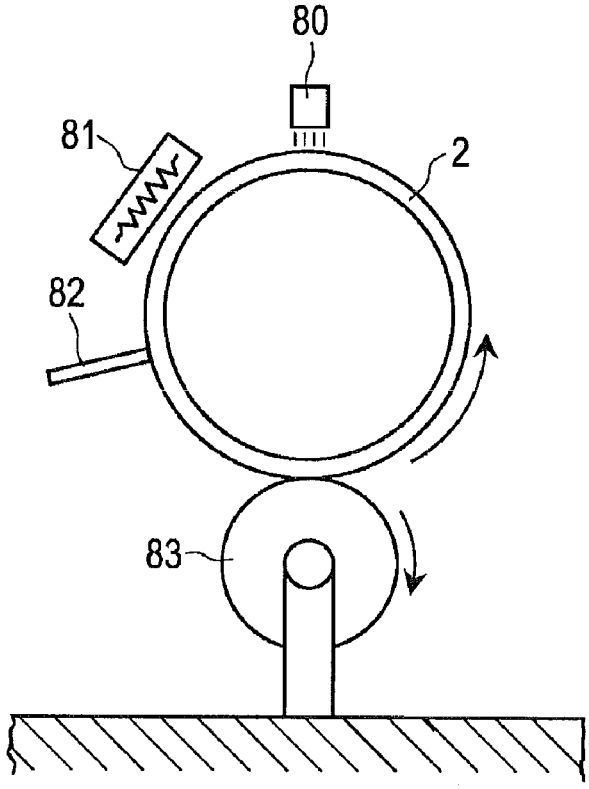
FIG. 10 is a schematic view of another apparatus for forming a resin portion upon a electrophotographic photoreceptor.

For example, as illustrated in FIG. 10, a liquid material (resin coating material) is applied to the photosensitive layer 21 with a spray coater 80, while the electrophotographic photoreceptor 2 is rotated. After the resin coating material is heat-treated with a heat treatment apparatus 81, an excessive resin coating material is removed with a blade 82 and a finishing roller 83.

The present invention will be further described with Examples. The present invention is not limited to the Examples.

Example 1

Toner deposition was observed after image forming in both cases where a protrusion disposed on an electrophotographic photoreceptor is or is not covered with a resin portion.

(Production of Electrophotographic Photoreceptor)

Electrophotographic photoreceptors A and B according to Comparative Examples and electrophotographic photoreceptors C1, C2, D1 and D2 according to Examples were produced.

The electrophotographic photoreceptor A was produced as follows. A cylindrical substrate was mirror-finished and washed. A photosensitive layer was formed on the cylindrical substrate with a plasma CVD apparatus 5 illustrated in FIG. 3. The cylindrical substrate was an aluminum cylindrical substrate having a diameter of 84 mm and a length of 370 mm. The photosensitive layer had a three-layered structure composed of a p-type charge injection preventing layer, an a-Si photoconductive layer, and an a-Si surface layer. The p-type charge injection preventing layer was formed using $SiH_4$, $B_2H_6$, $H_2$, and NO as reaction gases, and had a thickness of 4 μm. The a-Si photoconductive layer was formed using $SiH_4$, $H_2$, and $B_2H_6$ as reaction gases, and had a thickness of 27 μm. The a-Si surface layer was formed using $SiH_4$ and $CH_4$ as reaction gases, and had a thickness of 0.7 μm.

The electrophotographic photoreceptor B was produced as follows. A photoreceptor produced in the same way as the electrophotographic photoreceptor A was attached to a umbrella-shaped center pin, and was installed in a rotator. The photoreceptor was rotated at 60 revolutions per minute (rpm) to grind a protrusion disposed on the photoreceptor with a lapping sheet (planarization), thus producing the electrophotographic photoreceptor B.

The electrophotographic photoreceptors C were produced as follows: a photoreceptor subjected to the planarization as in the electrophotographic photoreceptor B was brought into contact with a resin-coated sheet to cover the protrusion and its periphery with a resin portion (see FIG. 8C). The resin portion was formed of a fluorocarbon resin (C2) or a polystyrene resin (C1).

The electrophotographic photoreceptors D were produced as follows: a photoreceptor (not subjected to planarization) produced in the same way as the electrophotographic photoreceptor A was brought into contact with a resin-coated sheet to cover the protrusion and its periphery with a resin portion (see FIG. 5C). The resin portion was formed of a fluorocarbon resin (D2) or a polystyrene resin (D1).

(Evaluation of Toner Deposition)

The electrophotographic photoreceptor A, B, C, or D was installed in an image-forming apparatus (KM-8030, Kyocera Mita Corporation). After a plate wear test of 10,000 sheets, the electrophotographic photoreceptor was visually inspected. This test was performed in quintuplicate for each of the electrophotographic photoreceptors A, B, C, and D. The toner deposition was evaluated as the incidence of the toner deposition. The incidence of the toner deposition was defined by the ratio of the number of protrusions to which toner adhered to the total number of protrusions.

TABLE 1

| | Resin portion | | |
|---|---|---|---|
| | None | Polystyrene resin | Fluorocarbon resin |
| A | 25% | — | — |
| B | 5% | — | — |
| C | — | 0% (C1) | 0% (C2) |
| D | — | 8% (D1) | 2% (D2) |

Table 1 shows that, in a comparison of the electrophotographic photoreceptors A and D1 in which the protrusion was not truncated, the presence of the polystyrene resin portion reduced the incidence of the toner deposition from 25% to 8%, and the presence of the fluorocarbon resin portion (Example D2) reduced the incidence of the toner deposition to 2%. In a comparison of the electrophotographic photoreceptors B, C1 and C2 in which the protrusion was truncated, the presence of the polystyrene (C1) or fluorocarbon (C2) resin portion reduced the incidence of the toner deposition from 5% to 0%.

These results demonstrate that the formation of a resin portion can reduce the toner deposition.

Furthermore, the incidence of the toner deposition was lower in the electrophotographic photoreceptors C1 and C2, in which the truncated protrusion was covered with the resin portion, than in the electrophotographic photoreceptors D1 and D2, in which the full protrusion was covered with the resin portion.

This result demonstrates that the formation of a resin portion covering a truncated protrusion can further reduce the toner deposition.

Furthermore, the incidence of the toner deposition was lower in the electrophotographic photoreceptor D2 having the fluorocarbon resin portion than in the electrophotographic photoreceptor D1 having the polystyrene resin portion.

This result demonstrates that the fluorocarbon resin portion is preferred to the polystyrene resin portion.

Example 2

The surfaces of the photosensitive layers of the electrophotographic photoreceptors A and D1 in Example 1 were observed. Images after a plate wear test were evaluated.

Surface observation of the electrophotographic photoreceptor A before use showed that there were 20 protrusions having a diameter in the range of 0.1 to 0.2 mm and a height in the range of 15 to 50 μm.

The electrophotographic photoreceptor A was installed in an image-forming apparatus (KM-8030, Kyocera Mita Corporation). After a plate wear test of 10,000 sheets, surface observation of the photosensitive layer showed that there was discharge breakdown of one protrusion and that five of the 20 protrusions had toner deposition. Inspection of images after the plate wear test showed that there were two black spots in a white solid portion and six white spots in a gray image formed by performing an intermediate exposure (exposure at an intermediate point of the light decay from the dark voltage) to a black solid portion. The term "white solid portion", as used herein, refers to a printed portion corresponding to an unexposed portion of an electrophotographic photoreceptor.

Surface observation of the electrophotographic photoreceptor D1 before use showed that there were 25 protrusions having a diameter in the range of 0.1 to 0.2 mm and a height in the range of 15 to 50 μm.

The electrophotographic photoreceptor D1 was installed in the image-forming apparatus (KM-8030, Kyocera Mita Corporation). After a plate wear test of 10,000 sheets, two of the 25 protrusions had toner deposition, and the discharge breakdown of the protrusions was not observed. Inspection of images after the plate wear test showed that there was no black spot in a white solid portion and two white spots in a gray image formed by performing an intermediate exposure to a black solid portion.

Example 3

Surface observation of a photosensitive layer of an electrophotographic photoreceptor E and the evaluation of images after a plate wear test were performed as in Example 2. In the electrophotographic photoreceptor E, grinding of a protrusion and the formation of a resin portion were performed in a single step.

A photoreceptor (not subjected to planarization) produced in the same way as the electrophotographic photoreceptor A was treated with a lapping sheet to produce the electrophotographic photoreceptor E. The lapping sheet was composed of a polyethylene terephthalate base sheet and a fluorocarbon resin binder containing abrasive particles.

The lapping sheet was brought into contact with a photosensitive layer with an apparatus illustrated in FIG. 6. Grinding of a protrusion with the abrasive particles and the formation of a fluorocarbon resin portion were performed in a single step. The pressing force of the lapping sheet against the photosensitive layer was appropriately controlled to selectively cover a protrusion with a resin portion (see FIG. 8C).

Surface observation of the electrophotographic photoreceptor E before use showed that there was no protrusion having a diameter in the range of 0.1 to 0.2 mm and a height in the range of 15 to 50 μm.

The electrophotographic photoreceptor E was installed in an image-forming apparatus (KM-8030, Kyocera Mita Corporation). After a plate wear test of 10,000 sheets, surface observation of the photosensitive layer showed that there was no discharge breakdown and no substantial toner deposition. Inspection of images after the plate wear test showed that there was no black spot in a white solid portion and no white spot in a gray image formed by performing an intermediate exposure to a black solid portion.

Example 4

Surface observation of a photosensitive layer of an electrophotographic photoreceptor F and the evaluation of images after a plate wear test were performed as in Example 2. In the electrophotographic photoreceptor F, a resin portion was formed with an apparatus illustrated in FIG. 10.

The electrophotographic photoreceptor F was produced as follows. A photoreceptor produced in the same way as the electrophotographic photoreceptor A was attached to a umbrella-shaped center pin, and was installed in an rotator. A resin coating material was applied to a photosensitive layer with a spray coater, while the electrophotographic photoreceptor F was rotated. A rubber blade was then brought into contact with the rotated photoreceptor to scrape the resin coating material off a normal surface. A finishing roller was then brought into contact with the rotated photoreceptor to further scrape the resin coating material off the normal surface. Thus, a protrusion disposed on the electrophotographic photoreceptor F was selectively covered with the resin coating material (see FIG. 5C).

Surface observation of the electrophotographic photoreceptor F before use showed that there were 20 protrusions having a diameter in the range of 0.1 to 0.2 mm and a height in the range of 15 to 50 μm.

The electrophotographic photoreceptor F was installed in an image-forming apparatus (KM-8030, Kyocera Mita Corporation). After a plate wear test of 10,000 sheets, surface observation of the photosensitive layer showed that there was no discharge breakdown and that two of the 20 protrusions had toner deposition. Inspection of images after the plate wear test showed that there was one black spot in a white solid portion and two white spots in a gray image formed by performing an intermediate exposure to a black solid portion.

Table 2 summarizes the results of Examples 2, 3, and 4.

TABLE 2

| | Comparative Example Electrophotographic photoreceptor A | Example 2 Electrophotographic photoreceptor D1 | Example 3 Electrophotographic photoreceptor E | Example 4 Electrophotographic photoreceptor F |
|---|---|---|---|---|
| Toner deposition | 25% | 8% | 0% | 10% |
| Discharge breakdown | 0% | 0% | 0% | 0% |
| Black spot | 10% | 4% | 0% | 5% |
| Evaluation | Poor | Fair | Good | Fair |

Table 2 shows that toner deposition, discharge breakdown, and black spots were reduced in the electrophotographic photoreceptors D1, E, and F according to the present embodiments, as compared with the conventional electrophotographic photoreceptor A having no resin portion. Thus, the present invention can provide an electrophotographic photoreceptor exhibiting less toner deposition and fewer black spots than before without deterioration of discharge breakdown. Furthermore, according to the present invention, damage to a cleaning blade by a protrusion, insufficient cleaning, and black-striped image defects can be reduced.

What is claimed is:

1. An electrophotographic photoreceptor comprising:

an electrically conductive substrate;

a photosensitive layer comprising an a-Si material formed on the substrate, the photosensitive layer having a protrusion; and a resin portion partly or entirely covering the protrusion.

2. The electrophotographic photoreceptor according to claim 1, that exhibits reduced toner deposition compared to the electrophotographic photoreceptor that does not have any resin portion.

3. The electrophotographic photoreceptor according to claim 1, that exhibits reduced toner deposition sufficient that black spotting defects in images are not observed.

4. The electrophotographic photoreceptor according to claim 1, wherein the protrusion has a flat top.

5. The electrophotographic photoreceptor according to claim 1, wherein the resin portion substantially entirely covers the protrusion.

6. The electrophotographic photoreceptor according to claim 1, wherein the resin portion comprises a resin compound containing a fluorine atom.

7. A method for manufacturing an electrophotographic photoreceptor, comprising the steps of:

forming a photosensitive layer comprising an a-Si material on an outer surface of a cylindrical substrate, the photosensitive layer having a protrusion; and partly or entirely covering the protrusion of the inorganic photosensitive layer with a resin.

8. The method for manufacturing an electrophotographic photoreceptor according to claim 7, wherein the covering step further comprises grinding of the protrusion.

9. An image-forming apparatus comprising an electrophotographic photoreceptor, the electrophotographic photoreceptor comprising:

a cylindrical substrate;

an photosensitive layer comprising an a-Si material on the cylindrical substrate, the photosensitive layer having a plurality of protrusion; and a resin portion partly or entirely covering the protrusion.

10. The image-forming apparatus according to claim 9, in which the electrophotographic photoreceptor exhibits reduced toner deposition compared to the electrophotographic photoreceptor that does not have any resin portion.

11. The image-forming apparatus according to claim 9, in which the electrophotographic photoreceptor exhibits reduced toner deposition sufficient that black spotting defects in images are not observed.

12. The image-forming apparatus according to claim 9, wherein the protrusion has a flat top.

13. The image-forming apparatus according to claim 9, wherein the resin portion is disposed on the front side of the protrusion in the rotation direction of the electrophotographic photoreceptor.

14. The image-forming apparatus according to claim 9, wherein the resin portion substantially entirely covers the protrusion.

15. The image-forming apparatus according to claim 9, wherein the resin portion comprises a resin compound containing a fluorine atom.

* * * * *